US007507053B2

(12) United States Patent
Hall

(10) Patent No.: US 7,507,053 B2
(45) Date of Patent: Mar. 24, 2009

(54) OSCILLATING STRAIGHT STREAM NOZZLES

(76) Inventor: David R. Hall, 2185 S. Larsen Pkwy., Provo, UT (US) 84606

( * ) Notice: Subject to any disclaimer, the term of this patent is extended or adjusted under 35 U.S.C. 154(b) by 80 days.

(21) Appl. No.: 11/668,390

(22) Filed: Jan. 29, 2007

(65) Prior Publication Data

US 2008/0178415 A1 Jul. 31, 2008

(51) Int. Cl.
*E01C 23/09* (2006.01)

(52) U.S. Cl. ..... 404/92; 404/95; 404/129

(58) Field of Classification Search ..... 404/83–118
See application file for complete search history.

(56) References Cited

U.S. PATENT DOCUMENTS

| | | | | | |
|---|---|---|---|---|---|
| 3,987,964 | A | * | 10/1976 | Pittman et al. | 239/169 |
| 4,081,200 | A | * | 3/1978 | Cheung | 299/17 |
| 4,139,318 | A | | 2/1979 | Jakob | |
| 4,340,176 | A | * | 7/1982 | Bernard | 239/102.1 |
| 4,619,551 | A | * | 10/1986 | Juan et al. | 404/90 |
| 4,793,730 | A | | 12/1988 | Butch | |
| 4,796,808 | A | * | 1/1989 | Linda et al. | 239/175 |
| 4,827,559 | A | | 5/1989 | Norland | |
| 4,854,770 | A | * | 8/1989 | Puchala et al. | 404/75 |
| 5,078,540 | A | | 1/1992 | Jakob | |
| 5,361,993 | A | * | 11/1994 | Andersson | 239/752 |
| 5,465,456 | A | * | 11/1995 | Fellhauer et al. | 15/320 |
| 5,505,598 | A | | 4/1996 | Murray | |
| 5,565,032 | A | * | 10/1996 | Wyner | 118/63 |
| 5,794,854 | A | | 8/1998 | Yie | |
| 5,942,045 | A | * | 8/1999 | Raghavan et al. | 134/34 |
| 6,179,519 | B1 | * | 1/2001 | Hilmersson | 404/91 |
| 6,733,086 | B1 | | 5/2004 | McSharry | |
| 6,896,742 | B2 | * | 5/2005 | Geyer et al. | 134/21 |
| 2006/0045621 | A1 | * | 3/2006 | Potts et al. | 404/91 |

* cited by examiner

*Primary Examiner*—Raymond W Addie
(74) *Attorney, Agent, or Firm*—Tyson J. Wilde

(57) ABSTRACT

A system for removing material from a surface comprises at least one conduit that also has an outlet at a distal end. A straight stream nozzle may be disposed within the outlet and the conduit. Another end of the conduit is fixed with respect to the vehicle and is in communication with a fluid source. A cam assembly may be in mechanical communication with the conduit and be adapted to provide an oscillation motion at the distal end within the conduit's elastic range. The straight stream nozzle may be adapted to direct a stream of fluid to a removal mechanism.

17 Claims, 10 Drawing Sheets

OSCILLATING STRAIGHT STREAM NOZZLES

BACKGROUND OF THE INVENTION

This invention relates to fluid jet systems that are used to remove material from various surfaces using a fluid dispersed under pressure through a nozzle. Such systems may be used in both industrial and commercial settings for removing material such as oil, grease, anti-freeze, paint, blood, waste, soil, rubber, chemicals and so forth from various surfaces. In some applications the invention may be utilized to maintain the effectiveness and safety of paved surfaces such as roads, runways, or pavements by removing material that may be substantially detrimental to their quality or use.

In many applications it is desirable for the fluid jet system to provide the maximum coverage of fluid in order to remove the maximum amount of material from the surfaces being engaged without sacrificing any degree of fluid pressure. This is particularly important in applications where it may be difficult or costly to engage the same surface multiple times because of inefficient coverage or loss of pressure. In order to achieve the greatest amount of surface coverage, some fluid jet systems have been developed to incorporate rotating nozzles that may provide a wider range of spray of fluid, comparative to stationary nozzles. Rotary nozzle systems for example have proven to increase the overall fluid coverage however, by design, these systems often incorporate a rotary joint about a spindle that must be sealed in order to maintain the appropriate pressure to produce the required velocity of fluid spray. Many rotary systems that incorporate such spindles are often plagued with seal failure issues which drastically affects service life and often requires regular maintenance in order to keep the system in operation This is especially true when fluid pressure is increased causing the spindles to rotate faster which in turn increase the chances of seal failure because of wear. Increased fluid pressure in excess of 100 psi in some systems, can also cause various other components of the jet fluid system, including nozzles, to erode prematurely as a result of being exposed to excessive forces in a highly pressurized environment. When the nozzles begin to fail the overall effectiveness of the system to remove materials from surfaces is also drastically reduced and the system may become ineffective.

U.S. Pat. No. 5,794,854 by Yie, which is herein incorporated by reference for all that it contains, discloses a nozzle cone and an oscillating fluid-jet nozzle system capable of producing relatively high velocity, high frequency oscillating fluid jets useful in waterjetting and other industrial spray applications.

BRIEF SUMMARY OF THE INVENTION

The present invention is a fluid removal system comprising straight nozzles that may be manipulated by a cam assembly to oscillate laterally from side to side within a range to project a straight fluid stream that may be directed towards a removal mechanism. The fluid removal system may also comprise a wear resistant material that may comprise natural diamond, synthetic diamond, polycrystalline diamond, single crystalline diamond, cubic boron nitrate, chromium, stelite, titanium, nitride, manganese, aluminum, carbide, tungsten, niobium, silicon, or combinations thereof disposed within a portion of the nozzles, in an effort to help prolong the service life of the nozzles and the system. Unlike non oscillating systems the oscillating motion of this fluid removal system may greatly enhance the overall effectiveness of the system by negating the need to address sealing issues especially at higher fluid pressures that are typically found in rotary jet applications. The straight nozzles may be used to provide a higher concentration of fluid being directed towards the surface having a higher rate of velocity that is capable of effectively removing material from a surface. The removal mechanism may comprise a vacuum, brush, shovel, conveyor belt or other means that is incorporated to substantially remove both the fluid and material being removed leaving a substantially cleaner surface. In some embodiments the current invention may be critical in helping to maintain the continued effectiveness and or safe condition of paved surfaces such as those used for roads, airport runways, automotive race tracks and so forth In other embodiments the system could also be adapted to perform in other applications such as automotive car washes, automatic dishwashers, street cleaners, asphalt milling machines, water blasters, rust removal systems or other systems that use pressurized fluid to remove material from various surfaces.

DETAILED DESCRIPTION OF THE INVENTION AND THE PREFERRED EMBODIMENT

Figure 1:
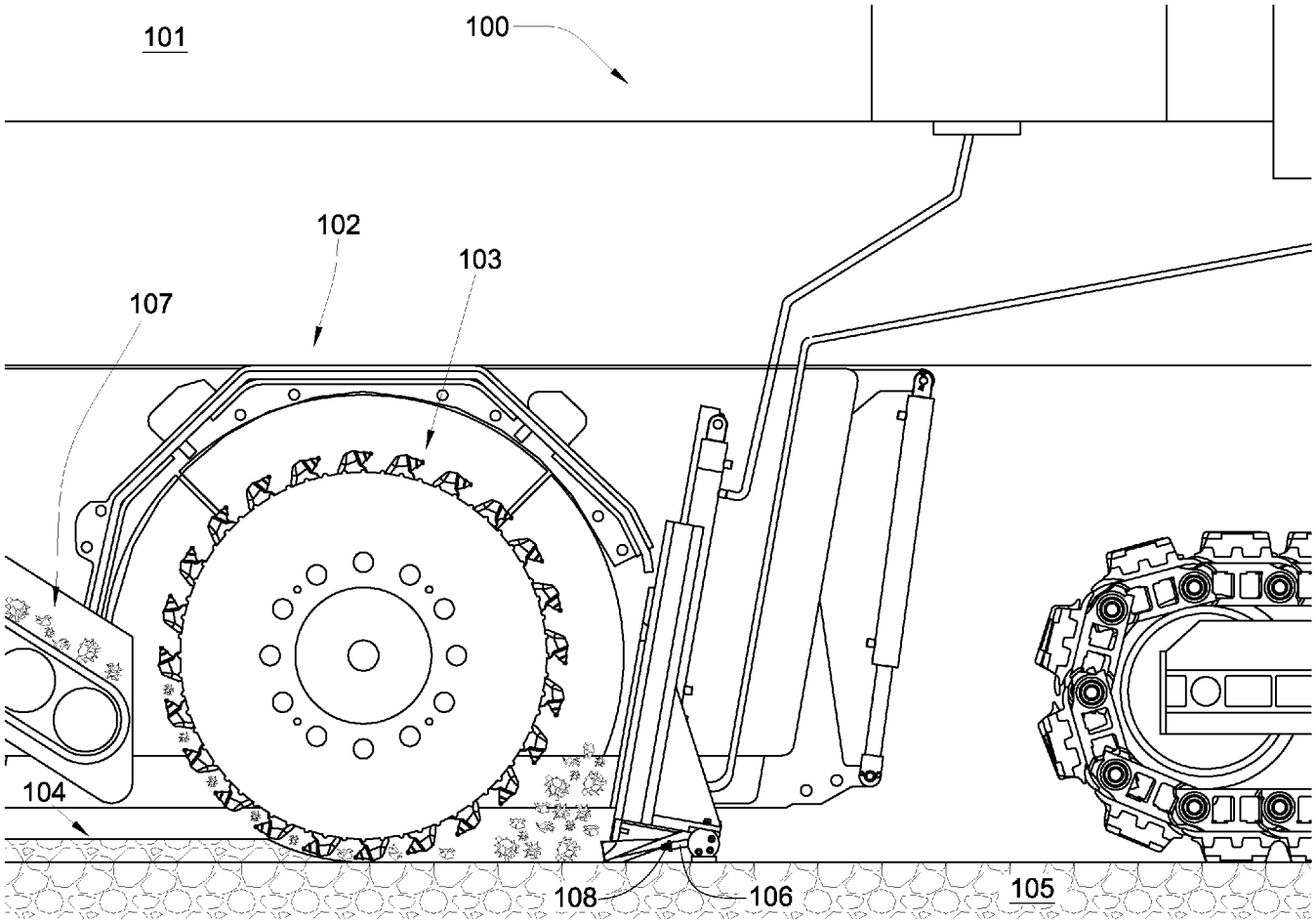
FIG. 1 is a perspective diagram of an embodiment depicting the current invention.

FIG. 1 discloses an embodiment of a removal system 100 attached to an asphalt milling machine 101. The removal system comprises a plurality of conduits 106 attached to the mold board of the milling machine. The conduits may be fluid jets adapted to direct the aggregate dislodged by the milling drum back towards the milling drum. In this embodiment the milling drum in connection with a conveyor belt 107 serve as a removal mechanism 102. The milling drum 103 may be attached to the underside of the milling machine 101 and may be adapted to effectively mill a layer 104 of a paved surface 105. The milling drum directs the loose aggregate and fluid from the jets towards the conveyor belt 107. The conveyor belt may be utilized to deposit the removed material and/or fluid into a collection area such as a dump truck (not shown). In some embodiments the removal system 100 may assist to provide a substantially cleaner surface free of loose material that may otherwise be detrimental to the paved surface or use thereof. In particular the cleaner milled surface would be advantageous for repaving where it is essential to have a clean surface for the proper reapplication of asphalt. Another advantage to having a cleaning system fixed behind the milling drum is the reduction of fines which may become airborne and pollute surrounding areas. The removal mechanism is important since the fluid emitted from the conduits can also interfere with attaching a layer of pavement or aggregate to the milled surface.

Figure 2:
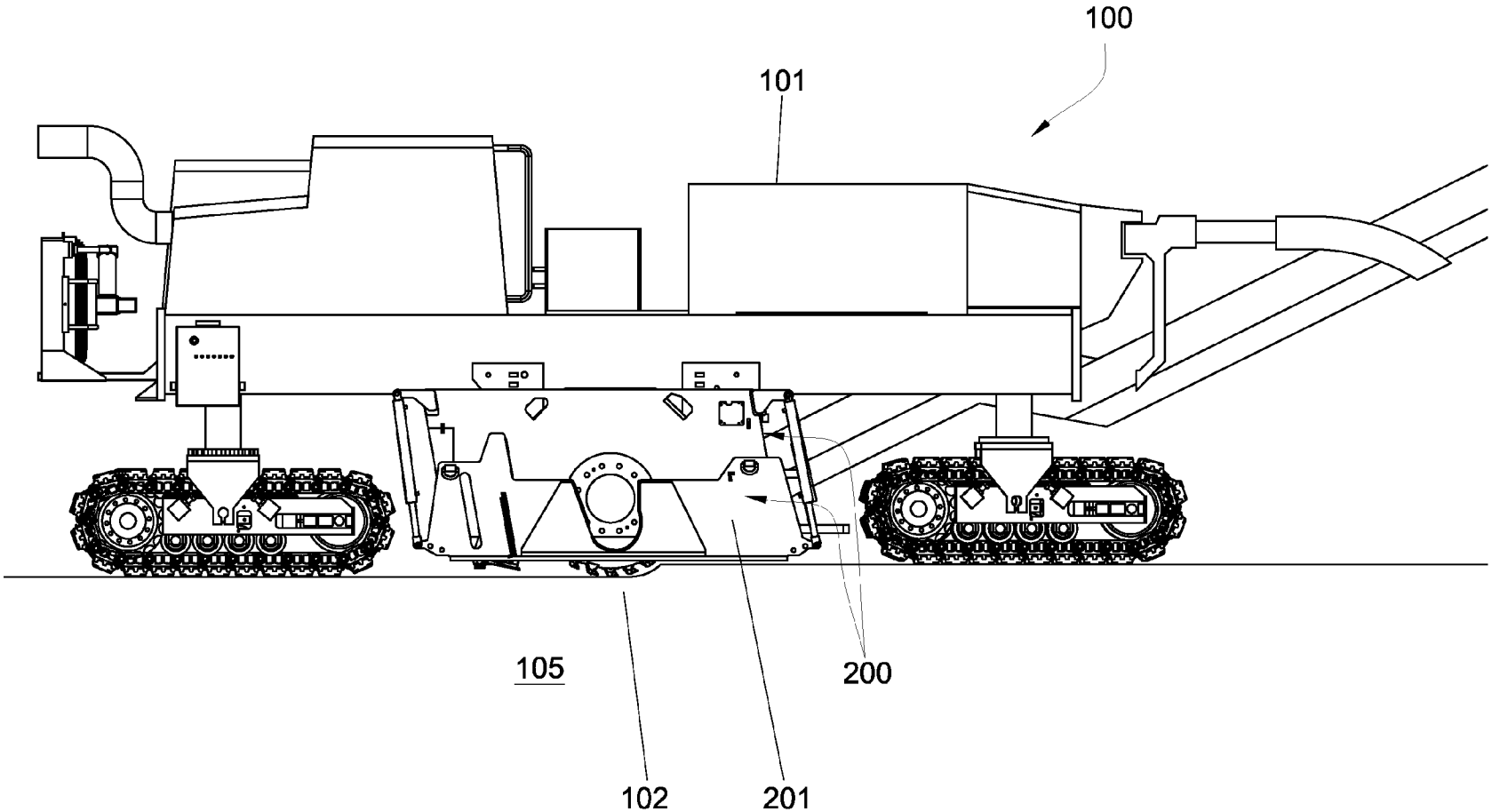
FIG. 2 is a perspective diagram of an embodiment depicting an asphalt milling machine.

FIG. 2 discloses another embodiment of the removal system 100 adapted as an asphalt milling machine 101 which shows that the components of the removal system 100 may be disposed within a chamber 201. The chamber 201 may be disposed proximate at least a portion of a paved surface. 105 such that the paved surface may help to form the chamber. In some embodiments the chamber 201 may also comprise sidewalls 202 that may provide a means of effectively containing and redirecting most of the fluid and material towards the removal mechanism 102 while substantially limiting the amount of remaining material from being dispersed outside of the chamber 201. In some embodiments this may also help to reduce the amount of residue that is left behind, leaving a substantially cleaner paved surface 105.

Figure 3:
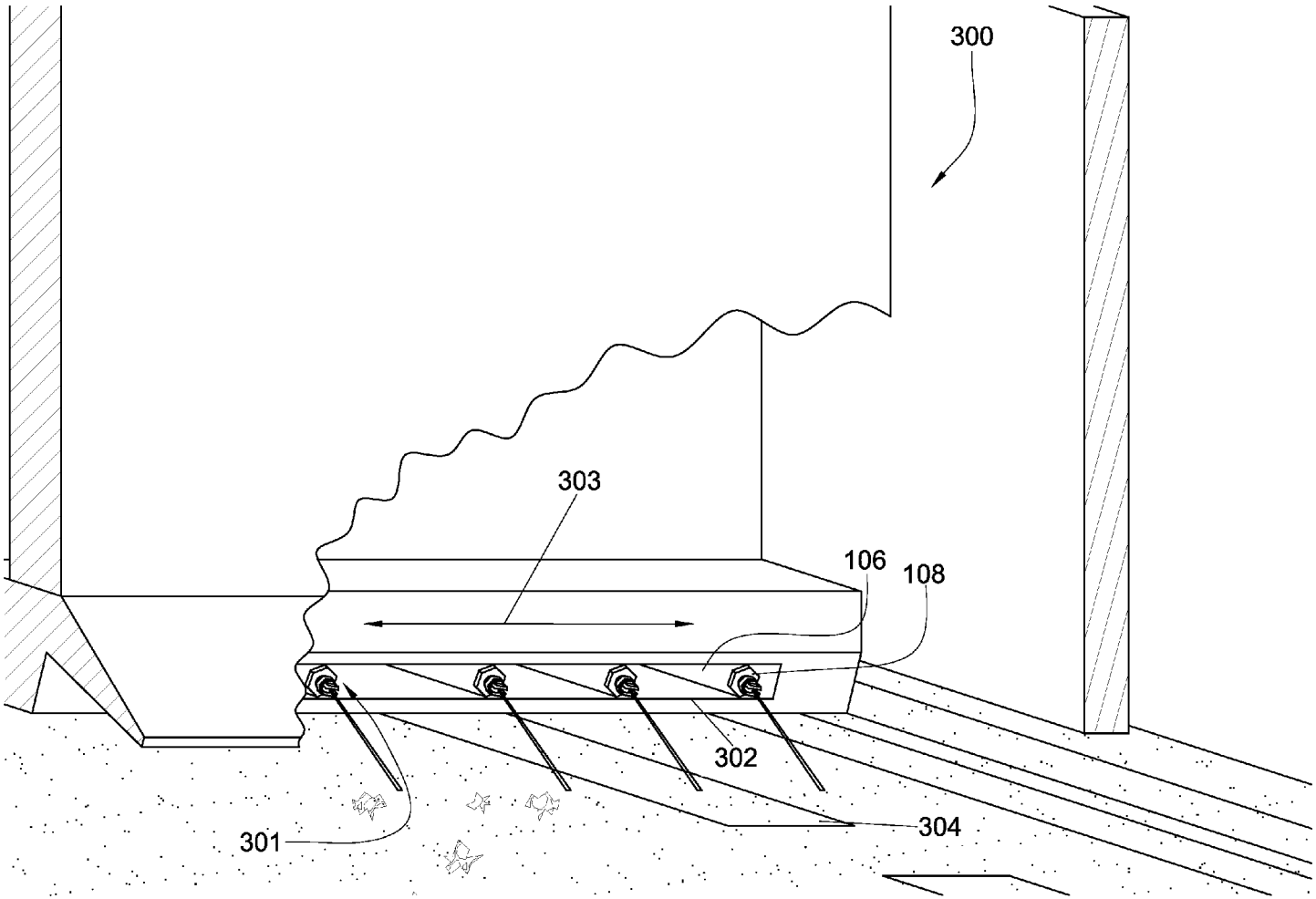
FIG. 3 is a cut away diagram of an embodiment depicting the at least one conduit.

FIG. 3 discloses another embodiment of the current invention depicting the at least one conduit 106 disposed in the distal end of a moldboard 300. In some embodiments the moldboard 300 may be adapted to direct material towards a removal mechanism (see FIG. 1). The conduit 106 may comprise an outlet 301 at a distal end and a straight nozzle 108 disposed within the outlet 301 being generally adapted to provide a straight stream of fluid to direct material underneath or in front of the moldboard 300 and towards a removal mechanism. In other embodiments the fluid may also be adapted to prevent dust from forming and substantially reduce friction, absorb heat and/or help to remove any material that may become lodged in the removal mechanism. The at least one conduit 106 may also be disposed within a slot 302 and adapted to oscillate in a selected generally lateral motion 303. The straight stream provided by the nozzles concentrate more energy together; thereby increasing the effectiveness of the stream in lifting, carrying, and dislodging aggregate or other waste materials from the milled surface. The oscillating lateral motion may assist increase the surface area covered by the streams. In some embodiments the removal system 100 may be utilized to remove road paint 304 while in other embodiments the removal system 100 may be utilized to remove material such as oil, grease, anti-freeze, blood, waste, soil, rubber, chemicals and so forth from various surfaces.

Figure 4:
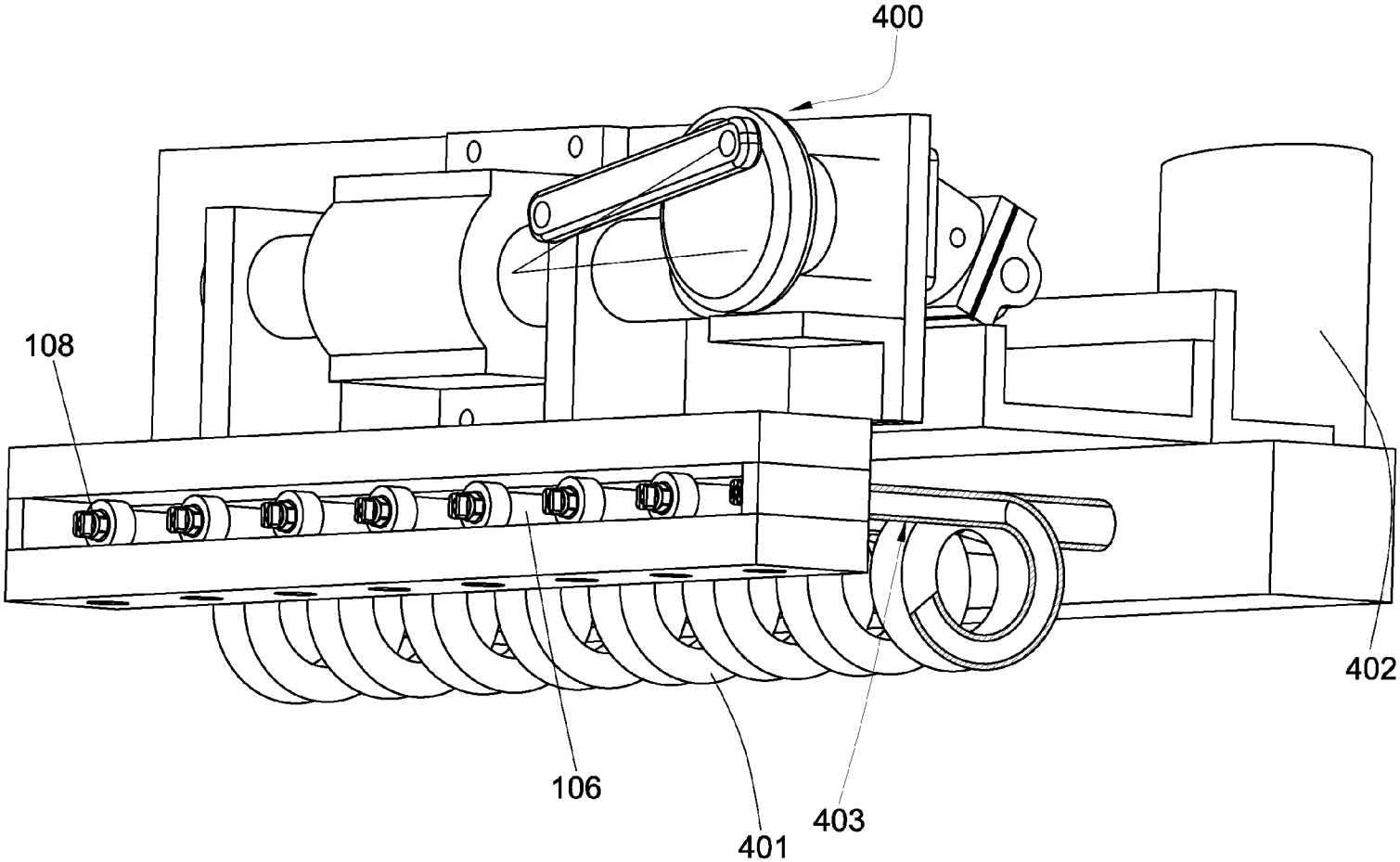
FIG. 4 is a perspective diagram of an embodiment depicting the cam assembly.

FIG. 4 discloses an embodiment of the current invention depicting a cam assembly 400 that may be in mechanical communication with the at least one conduit 106 and adapted to oscillate the distal end of the conduit 106 at a frequency of 1 inch per minute to 200 inches per minute within an elastic range between 0.010 and 5 inches, depending on the type of application and the level of intensity needed to engage the surface and/or material being worked. The cam assembly 400 may be driven by an electric, combustion pneumatic, hydraulic motor or combinations thereof that may be utilized to provide the necessary force to move the cam assembly 400 and provide the necessary oscillating motion In some embodiments the conduit 106 may also comprise a coiled portion 401 that may enable the conduit 106 to have a greater range of elasticity and susequently a wider range of oscillating motion. The coiled portion 401 may also assist to negate the need to address sealing issues due to the lack of moving or rotating components along the fluid path that may become prone to wear as typically experienced in other removal systems. The removal system 100 may also comprise a pump 402 that is disposed proximate the straight nozzles 108 and utilized to pressurize a bore 403 of the conduit 106 so that the fluid may become substantially pressurized before exiting the straight nozzles 108. The oscillating straight nozzles 108 may be used to effectively remove material from a surface by providing a higher concentration of fluid with a higher rate of velocity over a wider surface area. The assembly shown may be attached to the underside of the milling machine shown in FIG. 1, or it may be attached to underside or frame of another type of vehicle or trailer.

Figure 5:
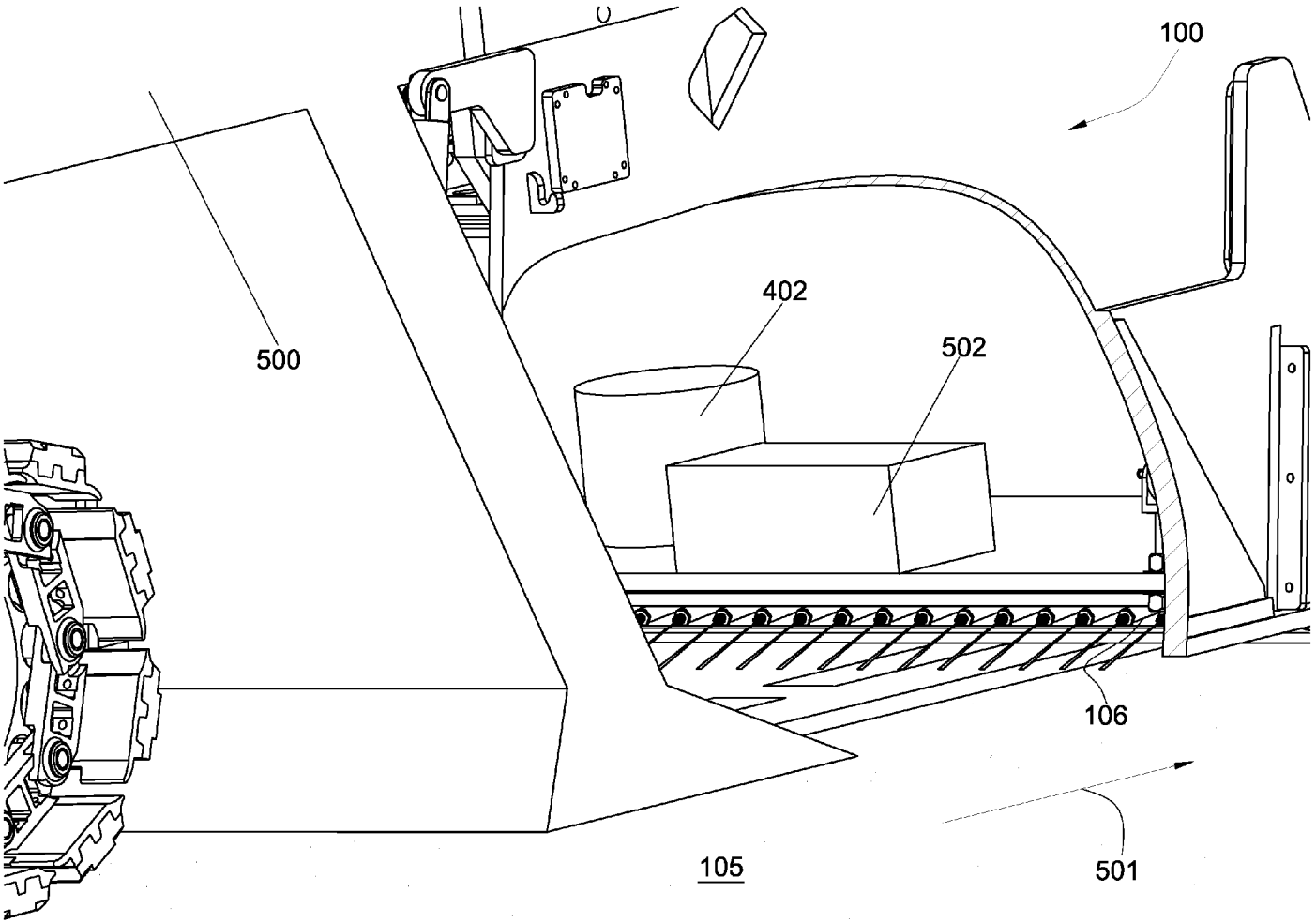
FIG. 5 is a cut away diagram of another embodiment of the current invention.

FIG. 5 discloses another embodiment of the current invention depicting the removal system 100 with the at least one conduit 106 attached to the underside of a vehicle 500 that may be motorized to traverse over a paved surface 105 in a selected direction 501 comprising a wheeled or tracked vehicle wherein the at least one conduit 106 may also be in communication with a fluid source 502. In some embodiments the fluid may become pressurized using the pump 402 such that the fluid may contain enough kinetic energy to effectively remove material from the paved surface 105 by the shear force of the fluid engaging the surface or material being worked. In other embodiments the fluid may comprise a chemical or chemicals that are capable of removing various materials from a surface without having to rely solely on kinetic energy alone. In some embodiments grit may be added to the fluid emitted from the nozzles to increase the abrasive nature of the fluid and improve the cleaning efficiency. In such applications however, the nozzles may be subjected to more wear. Ceramic nozzles made from diamond, cubic boron nitride, or cemented metal carbides may help prevent the wear in such embodiments.

Figure 6:
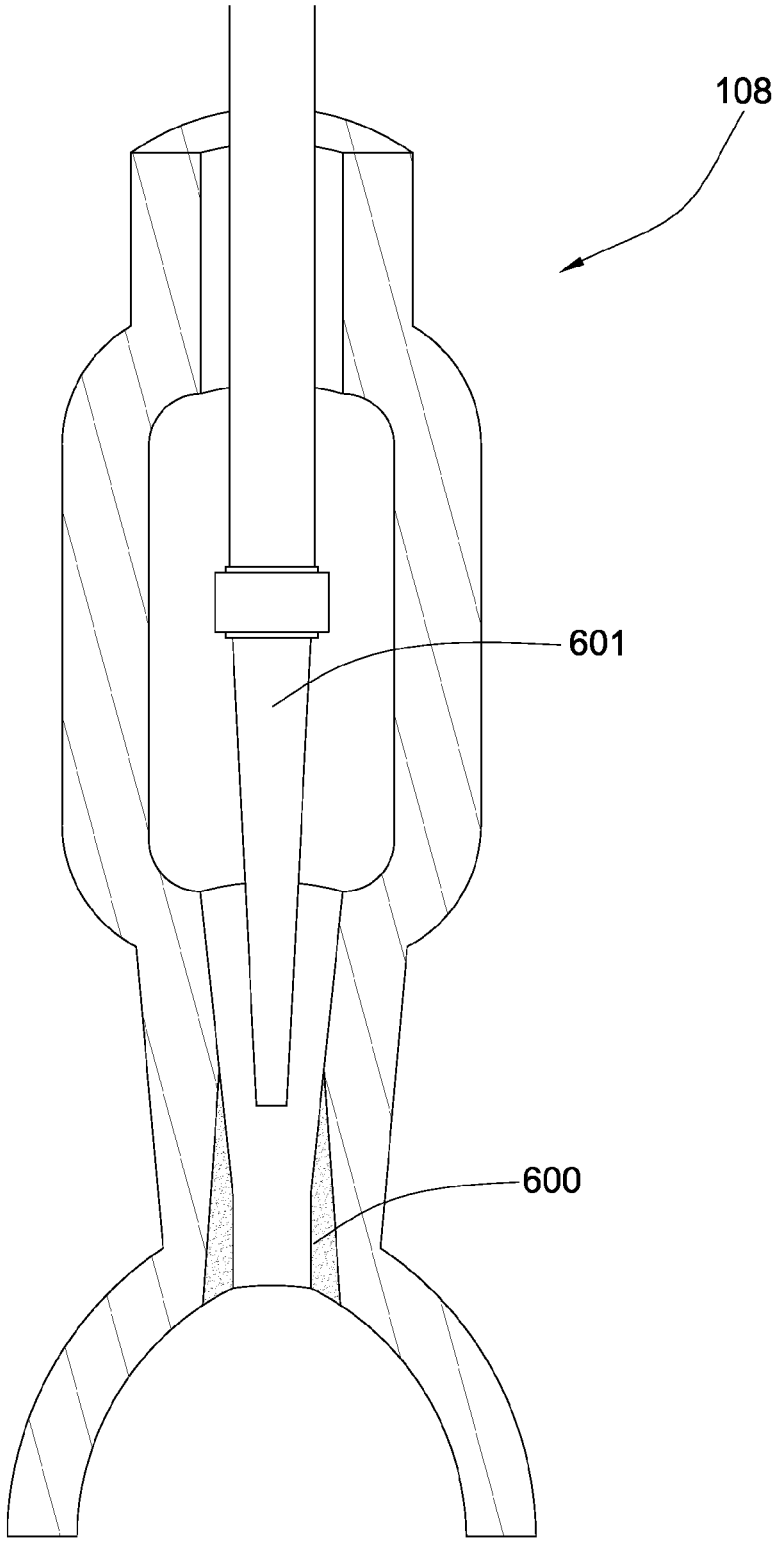
FIG. 6 is a cross sectional diagram of an embodiment depicting a nozzle.

FIG. 6 discloses another embodiment of the current invention depicting a straight nozzle 108 comprising a wear resistant material 600 that may comprise a hardness greater than 62 HRc and is utilized to reduce wear caused as pressurized fluid is forced through the nozzle 108. In some embodiments the wear resistant material 600 may comprise natural diamond, synthetic diamond, polycrystalline diamond, single crystalline diamond, cubic boron nitrate, chromium, stellite, titanium, nitride, manganese, aluminum, carbide, tungsten, niobium, silicon, or combinations thereof. This may be a significant feature in helping to reduce the amount of wear that may occur on the nozzle 108. In other embodiments the nozzle 108 may also comprise an automatic shut off stem 601 that is included in a closed loop system that may be activated in the event that the nozzle 108 becomes blocked or the fluid is to be redirected to another nozzle. The stem 601 may be used to clean the nozzle by pushing away debris clogged in the nozzle 108. In other embodiments, the stem 601 may be used to redirect the fluid so that it exits an adjacent nozzle 108, which may provide the benefit of building up pressure behind a clogged nozzle 108 until the debris is ejected out of it. The closed loop system may also be utilized to govern the flow of fluid through the nozzle 108 depending on the type of material being engaged or the type of application that the system is being used in. In some instances the closed loop system may be activated to provide more or less fluid depending on the desired velocity of the fluid to engage the material being worked. The closed loop system may also be used to monitor the pressure of the fluid and also be able to measure how well the surface is getting cleaned. In some cases, the closed loop system may direct the removal system to change their oscillating frequency, the operating pressure, the fluid temperature, or change the location of the removal mechanism.

Figure 7:
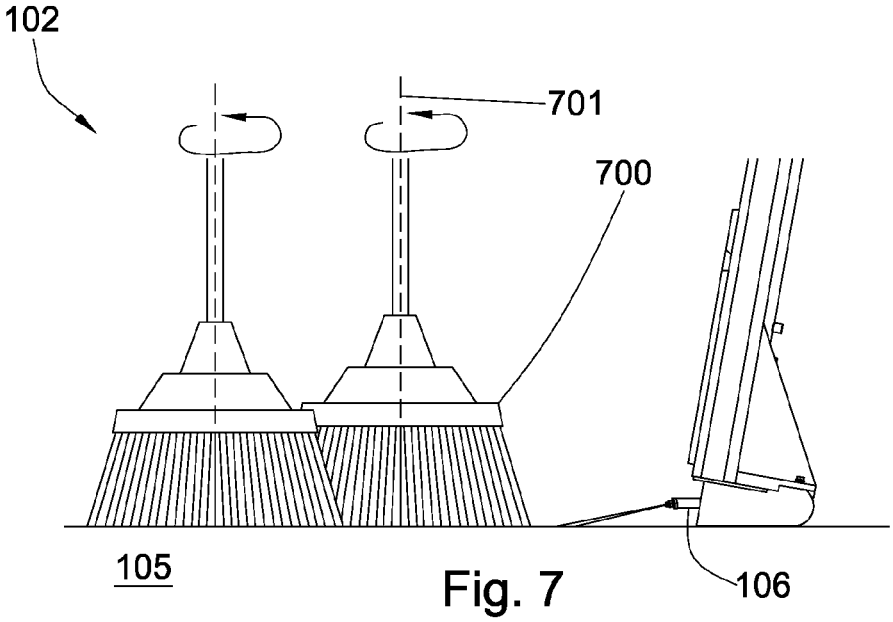
FIG. 7 is a perspective diagram of an embodiment of the current invention depicting a removal mechanism comprising rotational brushes.

FIGS. 7-10 disclose embodiments of the current invention depicting various removal mechanisms that may be selected from the following group consisting a brush, vacuum, shovel, conveyor belt or combinations thereof Referring now to FIG. 7, which discloses a removal mechanism 102 that may comprise at least one rotary brush 700 that may rotate about a vertical axis 701 to direct both the fluid and removed material away from the at least one conduit 106 and towards a collection area (not shown). In other embodiments the rotary brush may be disposed generally in front of the at least one conduit 106 and rotate about a horizontal axis in a clockwise direction so as to engage the material being worked and to direct removed material towards a collection area (not shown).

Figure 8:
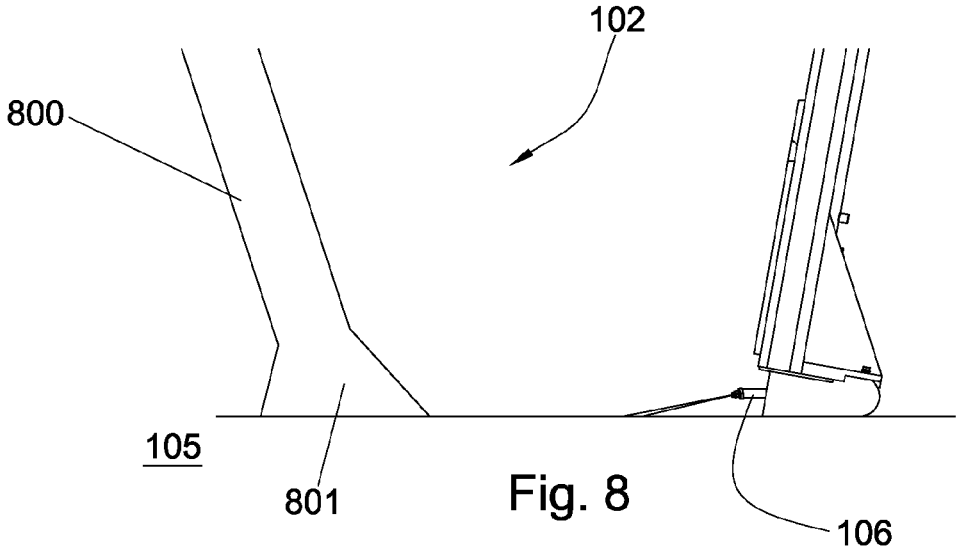
FIG. 8 is a perspective diagram of an embodiment of the current invention depicting a removal mechanism comprising a vacuum.

FIG. 8 discloses a vacuum 800 that may be disposed generally in front of the at least one conduit 106 and proximate the paved surface 105 and be utilized to substantially remove fluid or material towards the collection area. In some embodiments the vacuum 800 may comprise at least one vacuum head 801 at the distal end of the removal mechanism 102 that is proportional to the width of the spray of the at least one conduit 106.

Figure 9:
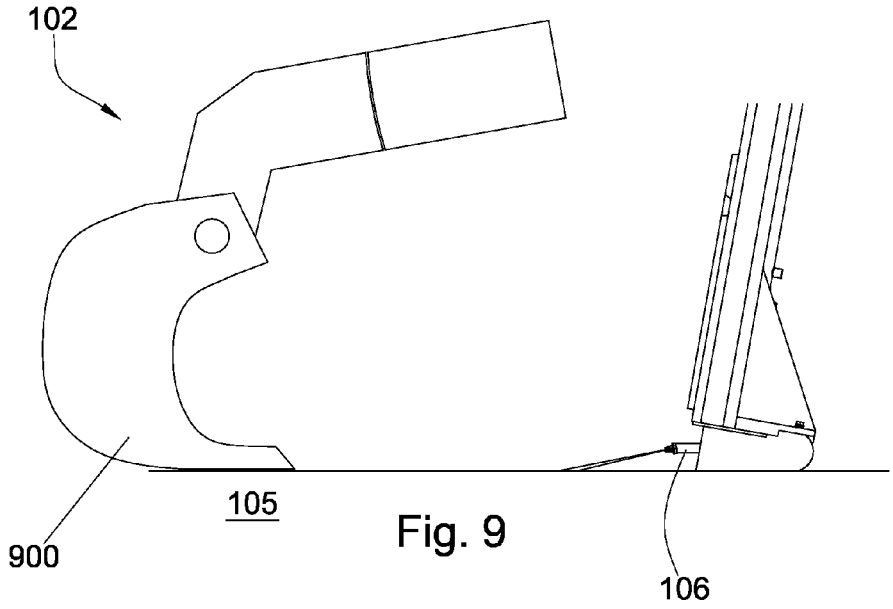
FIG. 9 is a perspective diagram of an embodiment of the current invention depicting a removal mechanism comprising a shovel.

FIG. 9 discloses a removal mechanism 102 that may comprise an articulated shovel 900 that may be utilized to substantially scoop material directed towards it. In some embodiments the shovel 900 may be manipulated to move longitudinally similar to a front end loader or latitudinally where the shovel may scoop laterally across the front of the at least one conduit 106 towards a collection area and substantially remove the fluid and material from the paved surface 105.

Figure 10:
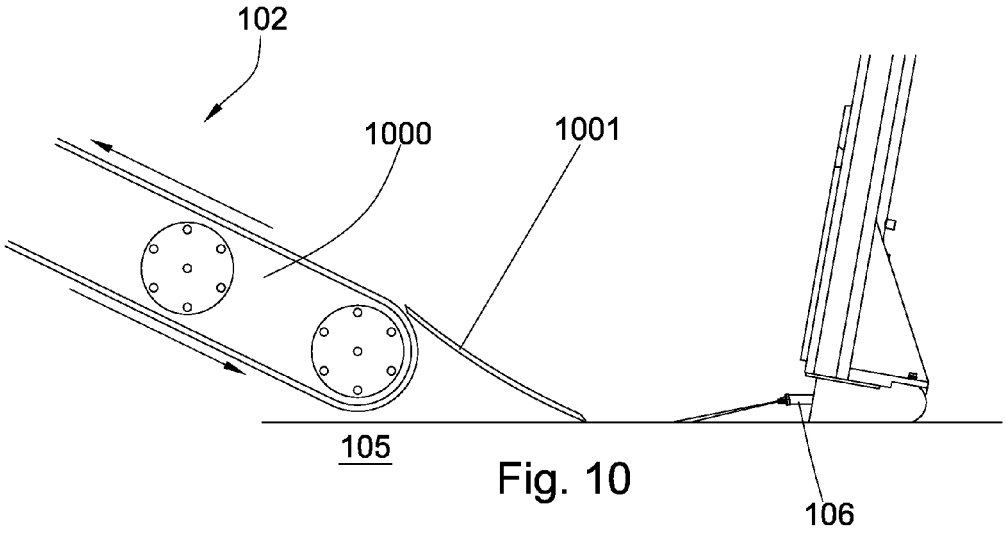
FIG. 10 is a perspective diagram of an embodiment of the current invention depicting a removal mechanism comprising a conveyor belt.

FIG. 10 discloses a another removal mechanism 102 that may comprise a conveyor belt 1000 that may be disposed in front of the at least one conduit 106. The conveyor belt 1000 may comprise a rubber flap portion 1001 disposed at the distal end of the belt and may assist to collect fluid and material from the surface 105 being directed at it from the at least one conduit 106 towards the conveyor belt 1000 for removal.

Figure 11:
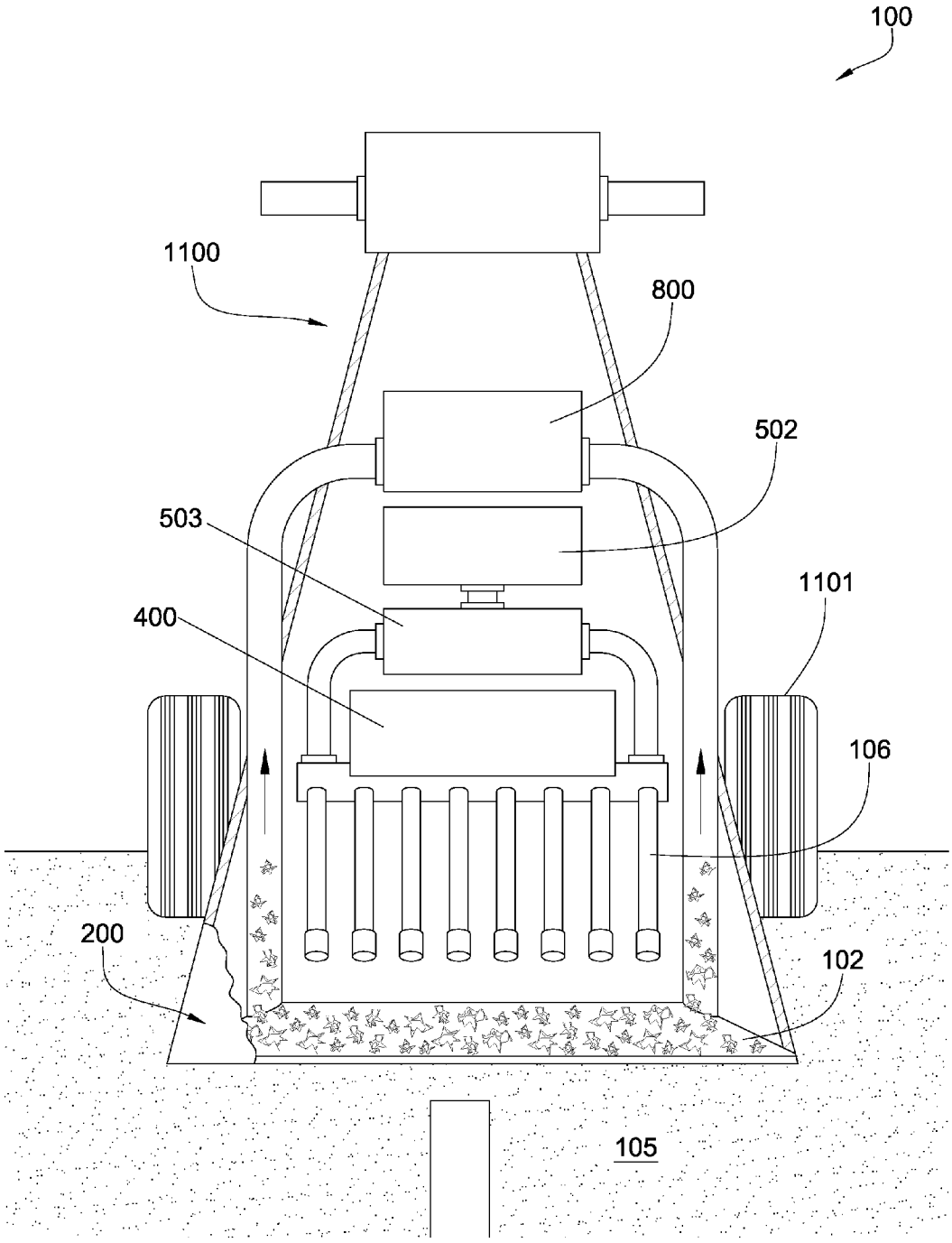
FIG. 11 is a perspective diagram of another embodiment of the current invention depicting a portable system.

FIG. 11 discloses another embodiment of the current invention depicting a non-motorized wheeled system 1100. The non-motorized wheeled system 1100 may comprise at least two wheels 1101 and a means to house the at least one conduit 106, a cam assembly 400, a pump 503, and a removal mechanism 102 within the non-motorized system 110. The system may be pushed manually and utilized to engage surface areas that are not practical for larger applications to engage such as side walks, etc. The removal mechanism 102 may comprise a vacuum 800 component that substantially encapsulates the at least one conduit to form a chamber 200 that may also comprise a portion of a paved surface 105. The removal mechanism 102 may be used to substantially remove any fluid and material that is directed at it as a result of the at least one conduit 106 engaging the surface. In other embodiments the non-motorized wheeled system 1100 may also comprise a fluid source 502 that is self contained within the removal system 100. In other embodiments the fluid source may comprise a separate component that is in communication with the removal system 100 such as a water hose.

Figure 12:
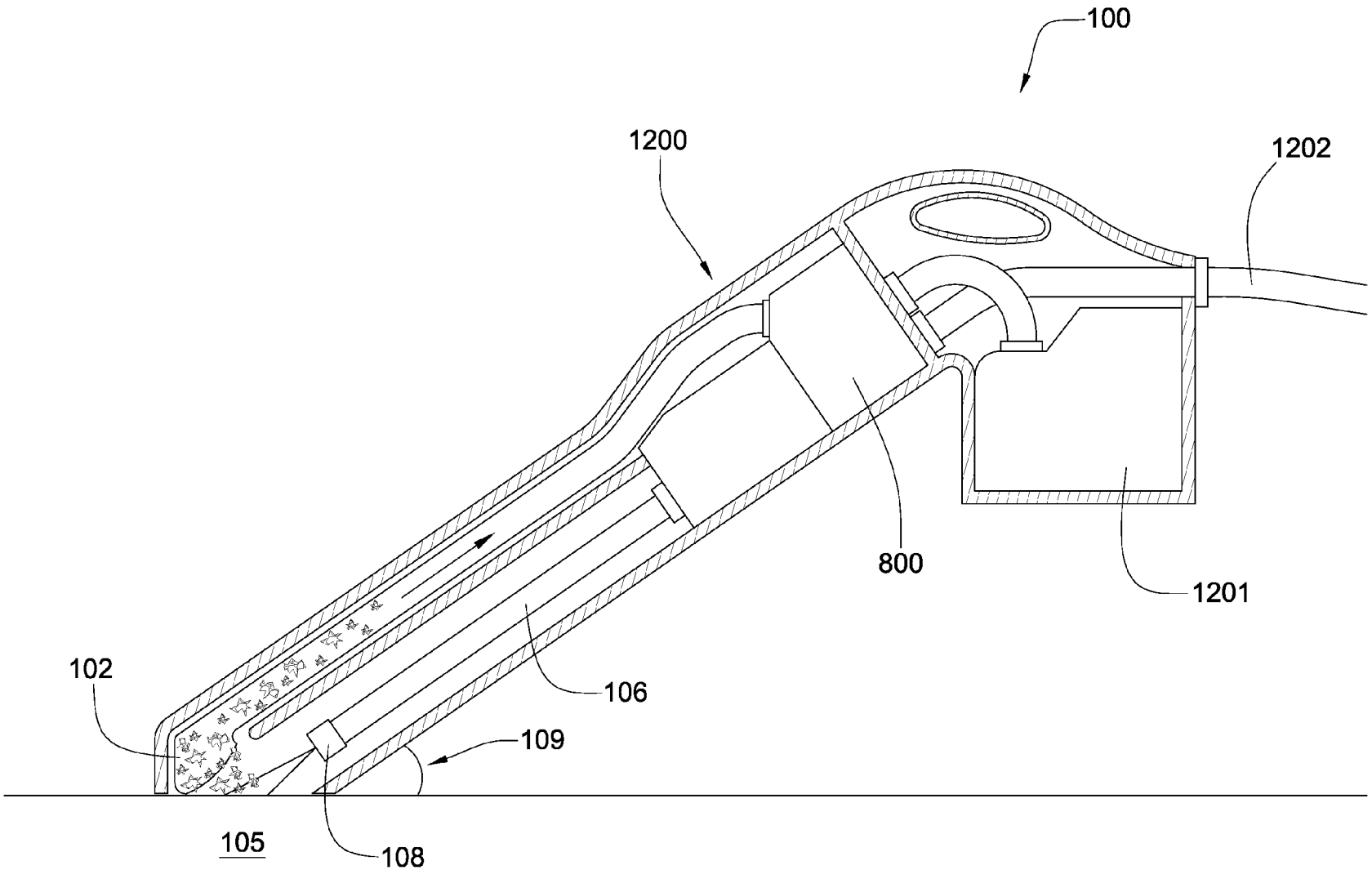
FIG. 12 is a cross sectional diagram of another embodiment of the current invention depicting a handheld system.

FIG. 12 discloses another embodiment of the removal system 100 adapted as a portable handheld system 1200. The handheld system 1200 may comprise a means to house the at least one conduit 106 such that the system may be easily manipulated by the user without much physical exertion In some embodiments the handheld system 1200 may comprise a removal mechanism 102 that comprises a vacuum 800 disposed in front of the at least one conduit 106 and is used to remove any fluid and material that is removed from the surface that the system may engage. The waste fluid and material may be directed towards a collecting area 1201. The handheld system 1200 may be utilized to clean more detailed areas and may also be utilized for domestic purposes. In some embodiments the fluid source may be in communication with the hand held system via a hose 1202 while in other embodiments the fluid source may be fully self contained within a portion of the handheld system The straight nozzles 108 may be positioned to direct a stream of fluid that may form an angle 109 up to 45 degrees with the paved surface 105. In some embodiments the angle 109 at which the straight nozzles 108 are positioned may be critical in determining the correct amount of pressure required to effectively remove material from a surface while also reducing the effect of back spray which could cause the straight nozzles 108 to become blocked with debris.

Whereas the present invention has been described in particular relation to the drawings attached hereto, it should be understood that other and further modifications apart from those shown or suggested herein, may be made within the scope and spirit of the present invention.

What is claimed is:

1. A system for removing material from a surface comprising;

at least one conduit connected to an underside of a motorized vehicle and comprising an outlet at a distal end and a straight stream nozzle disposed within the outlet;

another end of the conduit being fixed with respect to the vehicle and being in communication with a fluid source;

a cam assembly being in mechanical communication with the conduit and being adapted to generally oscillate the distal end within the conduit's elastic range;

the straight stream nozzle aimed towards a removal mechanism and positioned such that a stream of fluid from the nozzle forms less than a 45 degree angle with the surface; and wherein the vehicle is a pavement milling machine.

2. The system of claim 1, wherein cam assembly is adapted to move the distal end 0.010 to 5 inches.

3. The system of claim 1, wherein the conduit comprises a plurality of outlets.

4. The system of claim 1, wherein the nozzle comprises a material comprising a hardness greater than 62 HRc.

5. The system of claim 1, wherein the conduit comprises a shut off valve in communication with a closed loop system.

6. The system of claim 1, wherein the conduit comprises a coiled portion.

7. The system of claim 1, wherein the cam assembly is adapted to oscillate the distal end at a frequency of 1 inch per minute to 200 inches per minute.

8. The system of claim 1, wherein the cam assembly is driven by a motor.

9. The system of claim 1, wherein the conduit is secured to a frame or an underside of the vehicle.

10. The system of claim 1, wherein the distal end of the conduit and the removal mechanism are disposed within a chamber.

11. The system of claim 10, wherein the chamber is disposed proximate at least a portion of a paved surface.

12. The system of claim 1, wherein the removal mechanism comprises a brush.

13. The system of claim 12, wherein the brush is a rotary brush.

14. The system of claim 1, wherein the removal mechanism comprises a vacuum.

15. The system of claim 1, wherein the removal mechanism comprises a shovel.

16. The system of claim 1, wherein the removal mechanism comprises a conveyor belt.

17. The system of claim 1 wherein the removal mechanism comprises a milling drum attached to the underside of a vehicle.

* * * * *